US007121656B2

(12) United States Patent
Hattori

(10) Patent No.: US 7,121,656 B2
(45) Date of Patent: Oct. 17, 2006

(54) INK CARTRIDGE

(75) Inventor: Shingo Hattori, Tsushima (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 259 days.

(21) Appl. No.: 10/924,855

(22) Filed: Aug. 25, 2004

(65) Prior Publication Data

US 2005/0093944 A1 May 5, 2005

(30) Foreign Application Priority Data

Aug. 26, 2003 (JP) ..... 2003-301354

(51) Int. Cl.
*B43K 5/14* (2006.01)

(52) U.S. Cl. ..... 347/86; 347/84

(58) Field of Classification Search ..... None
See application file for complete search history.

(56) References Cited

U.S. PATENT DOCUMENTS 5,329,306 A 7/1994 Carlotta
6,336,709 B1 1/2002 Inoue et al.

FOREIGN PATENT DOCUMENTS

EP 1 114 725 A2 7/2001
EP 1 256 452 A1 11/2002
JP A 9-262988 10/1997
JP A 11-091132 4/1999
JP A 11-105305 4/1999
JP 1 095 777 A2 5/2001
JP A 2001-121715 5/2001
WO WO 02/28650 A1 4/2002

*Primary Examiner*—Manish S. Shah
*Assistant Examiner*—Han Samuel Choi
(74) *Attorney, Agent, or Firm*—Oliff & Berridge, PLC

(57) ABSTRACT

An ink cartridge has a storage space that receives a porous material for absorbing ink and having a pair of side walls opposed to each other, a first cover member, and a spacer member projecting from the first cover member into the storage space so as to occupy a predetermined space, the spacer member having an outer circumferential wall, a bottom wall and a support wall, the outer circumferential wall extending substantially along an inner surface of the storage space in section, the bottom wall covering a porous-material-side end portion of the outer circumferential wall, the support wall extending in a direction crossing the pair of side walls of the casing to be connected to inner surfaces of two sides of the outer circumferential wall. A space surrounded by the outer circumferential wall is made open to the outside through an opening portion formed to penetrate the first cover member.

10 Claims, 8 Drawing Sheets

INK CARTRIDGE

BACKGROUND OF THE INVENTION

1. Field of the Invention

The present invention relates to an ink cartridge, and particularly relates to an ink cartridge capable of reducing the ink capacity without changing the shape of its casing and capable of suppressing deterioration in degree of deaeration of ink.

2. Description of the Related Art

There has been hitherto known inkjet recording apparatus in which a black ink cartridge and a color ink cartridge are mounted so that ink is supplied from each ink cartridge to a recording head, and the ink is ejected from the recording head to a recording medium. In this inkjet recording apparatus, color ink is less frequently used than black ink in the use condition where the greater part of print data is text data. Thus, the validity of the color ink expires before the color ink is used up. As a result, there is a problem that the color ink cartridge is obliged to be exchanged for a new one so that the running cost increases. On the contrary, the black ink is less frequently used than the color ink in the use condition where the printing amount of color images is large. Thus, the validity of the black ink may expire before the black ink is used up. Further, when the inkjet recording apparatus itself is not frequently used, the validity of each ink may expire though both the black ink and the color ink are still in existence.

In order to solve the problem, it can be considered to manufacture an ink cartridge whose volume is reduced to reduce the ink capacity. However, there is a problem that a mold of such a low-volume ink cartridge has to be built up so that the cost increases. In addition, to mount the small ink cartridge on the inkjet recording apparatus, the shape of the mounting portion have to be changed. Thus, there is a problem that the cost increases more.

JP-A-9-262988 proposes an ink cartridge in which filler is charged into a bottom portion of a container forming a normal volume of the ink cartridge so as to reduce the ink volume. According to this ink cartridge, the ink filling amount can be reduced by charging the filler without changing the shape of the container. However, the shape of a porous material near an ink supply port is deformed. The ink supply port has the strongest influence on the ink outflow property with which ink flows into the recording head. Thus, there is a problem that there may occur a fluctuation in the print properties.

JP-A-2001-121715 proposes an ink cartridge including a container body communicating with an ink chamber through a supply port, a porous material to be impregnated with ink being received in the ink chamber, and a cover for sealing an opening portion of the container body, wherein a spacer is attached between the cover and the porous material. According to this ink cartridge, the ink filling amount can be reduced without changing the shape of the container while keeping the ink outflow property.

SUMMARY OF THE INVENTION

The aforementioned spacer is formed out of a plurality of plate-like ribs arranged in parallel so as to project from the cover toward the porous material. Therefore, there is a problem that the air existing in spaces among the ribs is dissolved into ink absorbed in the porous material so as to degrade the degree of deaeration of the ink.

The invention was developed to solve the foregoing problem. It is an object of the invention to provide an ink cartridge capable of reducing the ink capacity without changing the shape of a casing, and capable of suppressing deterioration in degree of deaeration of ink.

In order to attain the foregoing object, according to an aspect of the invention, there is provided an ink cartridge including: a casing having at least one open face and receiving ink, the casing including a storage space that receives a porous material for absorbing ink and having a pair of side walls opposed to each other while putting the storage space therebetween; a first cover member that closes the open face of the casing while facing to the storage space; and a spacer member projecting from the first cover member into the storage space so as to occupy a predetermined space between the porous material and the first cover member in the storage space, the spacer member having an outer circumferential wall, a bottom wall and a support wall, the outer circumferential wall extending substantially along an inner surface of the storage space in section perpendicular to a projecting direction of the spacer member, the bottom wall covering a porous-material-side end portion of the outer circumferential wall, the support wall extending in a direction crossing the pair of side walls of the casing to be connected to inner surfaces of two sides of the outer circumferential wall opposed to the pair of side walls; wherein a space surrounded by the outer circumferential wall is made open to the outside through an opening portion formed to penetrate the first cover member.

According to this ink cartridge, a predetermined space of the storage space receiving the porous material is occupied by the spacer member. Thus, the volume of the storage space is reduced, and the capacity of ink that can be received in the storage space is also reduced. It is therefore unnecessary to change the shape of the casing itself even when it is intended to reduce the ink capacity. Thus, the ink capacity can be reduced while the casing similar to that in the background art is used. Accordingly, even when a smaller volume of ink than that in the background art is received, economy can be achieved because another mold for an ink cartridge for the smaller ink volume does not have to be built up. In addition, since the spacer member is formed to project from the first cover member toward the porous material, the porous material can be prevented from floating.

BRIEF DESCRIPTION OF THE DRAWINGS

The present invention may be more readily described with reference to the accompanying drawings.

DETAILED DESCRIPTION OF THE PREFERRED EMBODIMENTS

Figure 1:
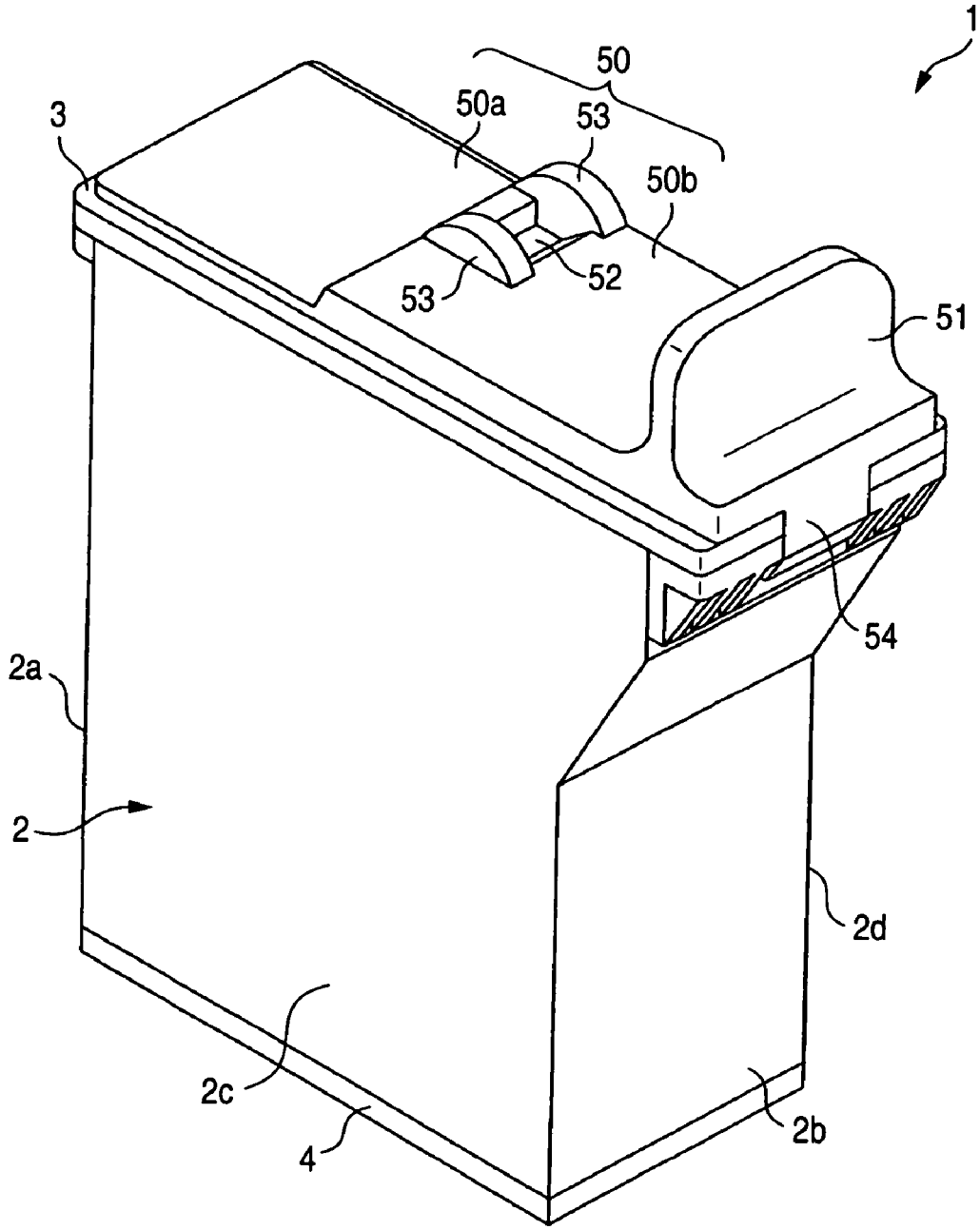
FIG. 1 is a perspective view showing an external appearance of an ink cartridge according to an embodiment of the invention.

A preferred embodiment of the invention will be described below with reference to the accompanying drawings. FIG. 1 is a perspective view showing an external appearance of an ink cartridge 1 according to an embodiment of the invention. The ink cartridge 1 is removably attached to an inkjet recording apparatus having a recording head that drives actuators constituted by piezoelectric elements so as to eject ink. The ink cartridge 1 serves to receive ink to be supplied to the recording head.

The ink cartridge 1 has a casing 2, an upper cover member 3, a lower cover member 4 and a fixing plate 50. The casing 2 is made from a transparent or translucent resin material and formed into a rectangular shape. The casing 2 has a pair of first side walls 2*a* and 2*b* opposed to each other, and a pair of second side walls 2*c* and 2*d* for connecting the pair of first side walls 2*a* and 2*b* with each other. The casing 2 has a rectangular cylindrical shape open in its opposite, upper and lower end faces. The upper and lower cover members 3 and 4 are formed in to plate-like shapes, and heat-welded to the upper and lower end portions of the first side walls 2*a* and 2*b* and the second side walls 2*c* and 2*d* so as to cover the opposite, upper and lower open faces of the casing 2 respectively.

The fixing plate 50 is formed into a plate-like shape having a thin portion 50*a* on the first side wall 2*a* side and a thick portion 50*b* on the first side wall 2*b* side, and fixed to the upper surface of the upper cover member 3. In addition, the thick portion 50*b* is provided with a grip portion 51, a first fitting recess portion 52, and a pair of side plates 53 and 53 provided erectly on the opposite sides of the first fitting recess portion 52 so as to put it therebetween.

The grip portion 51 is a portion to be gripped by an operator intending to attach the ink cartridge 1 to a head unit 70. The grip portion 51 is formed to project upward so as to be gripped easily. When the grip portion 51 is gripped to hold the ink cartridge 1, the ink cartridge 1 can be attached into a narrow space together with other ink cartridges 1 and in parallel therewith. Also when one of the plural ink cartridges 1 mounted in parallel is removed, the ink cartridge 1 can be removed without being disturbed by the other ink cartridges 1 adjacent thereto.

The first fitting recess portion 52 is a portion sinking in the thick portion 50*b* of the fixing plate 50. When the ink cartridge 1 is fixed to the head unit 70 (see FIG. 7), the first fitting recess portion 52 is a portion to be fitted to a first fitting protrusion portion 79 formed on the lower side of a fixing arm 71 of the head unit 70. When the first fitting protrusion portion 79 and the first fitting recess portion 52 are fitted to each other, the ink cartridge 1 can be prevented from slipping laterally while the ink cartridge 1 can be also prevented from floating from the head unit 70.

The pair of side plates 53 and 53 are also provided for preventing the ink cartridge 1 from sliding laterally. The side plates 53 and 53 are formed so that the distance between their opposed surfaces is substantially equal to the width of the first fitting protrusion portion 79. Accordingly, when the first fitting protrusion portion 79 and the first fitting recess portion 52 are fitted to each other, the first fitting protrusion portion 79 is put between the side plates 53 and 53 so that the ink cartridge 1 can be more surely prevented from sliding laterally.

Figure 2:
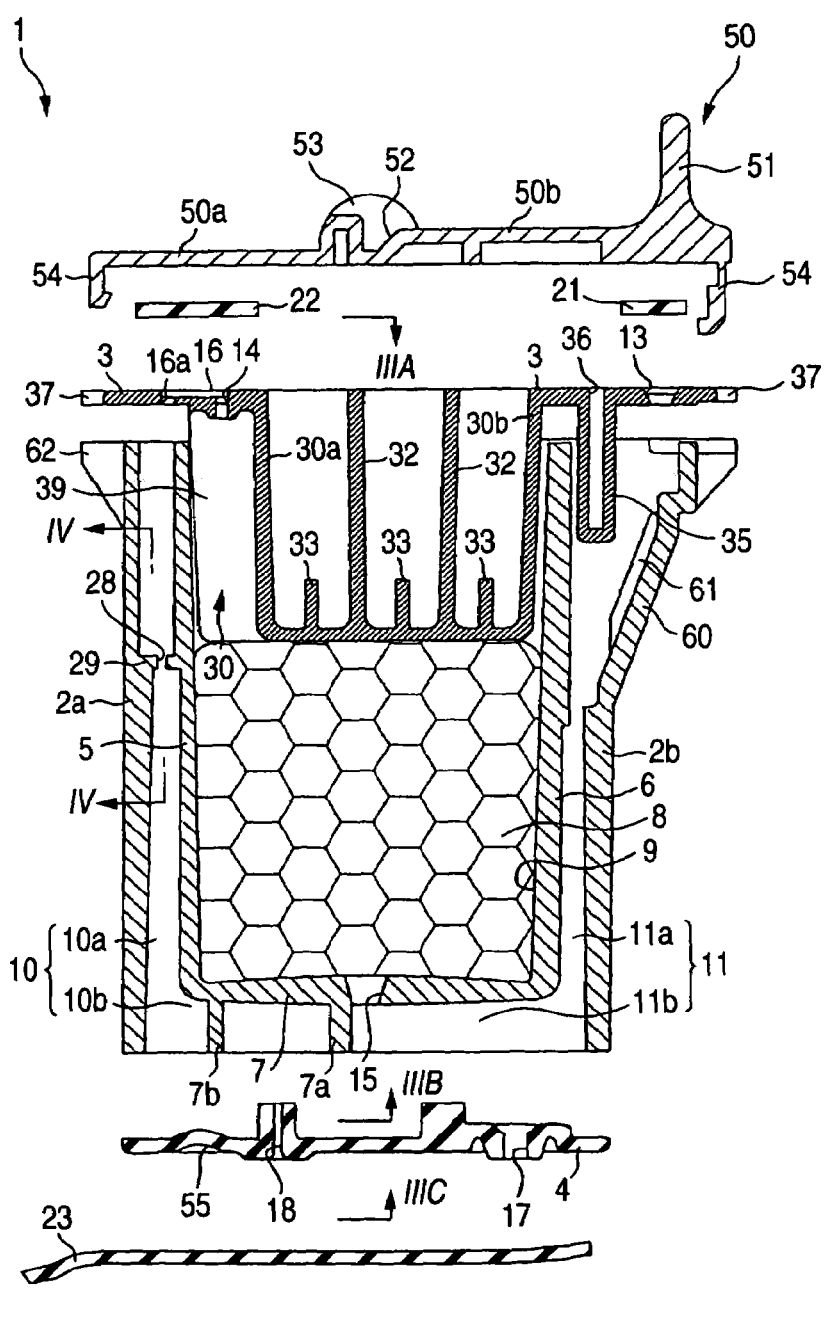
FIG. 2 is an exploded sectional view of the ink cartridge.
Figure 3A:
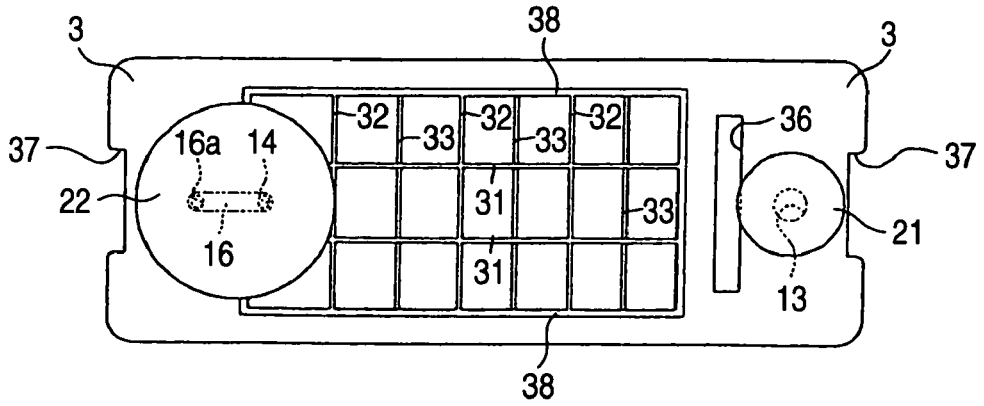
FIG. 3A is a plan view of an upper cover member in view from an arrow IIIA direction in FIG. 2.
Figure 3B:
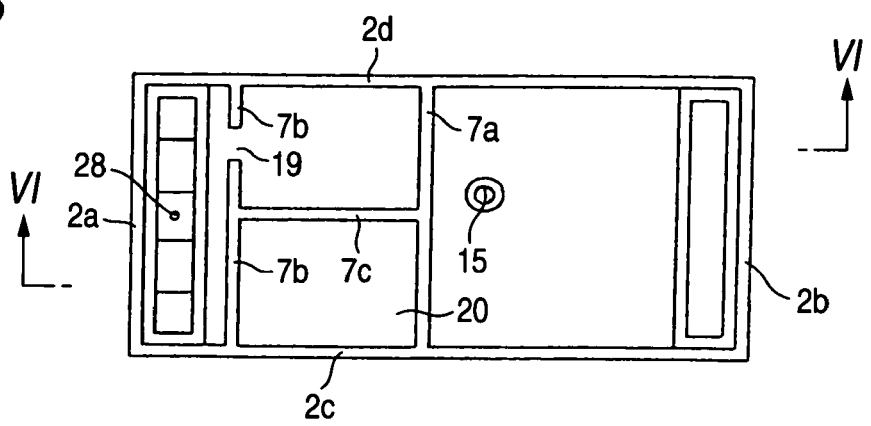
FIG. 3B is a plan view of a casing in view from an arrow IIIB direction in FIG. 2.
Figure 3C:
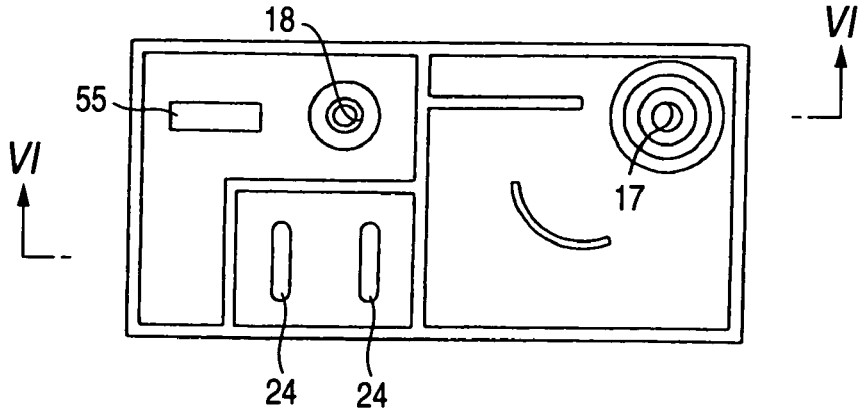
FIG. 3C is a plan view of a lower cover member in view from an arrow IIIC direction in FIG. 2.
Figure 4:
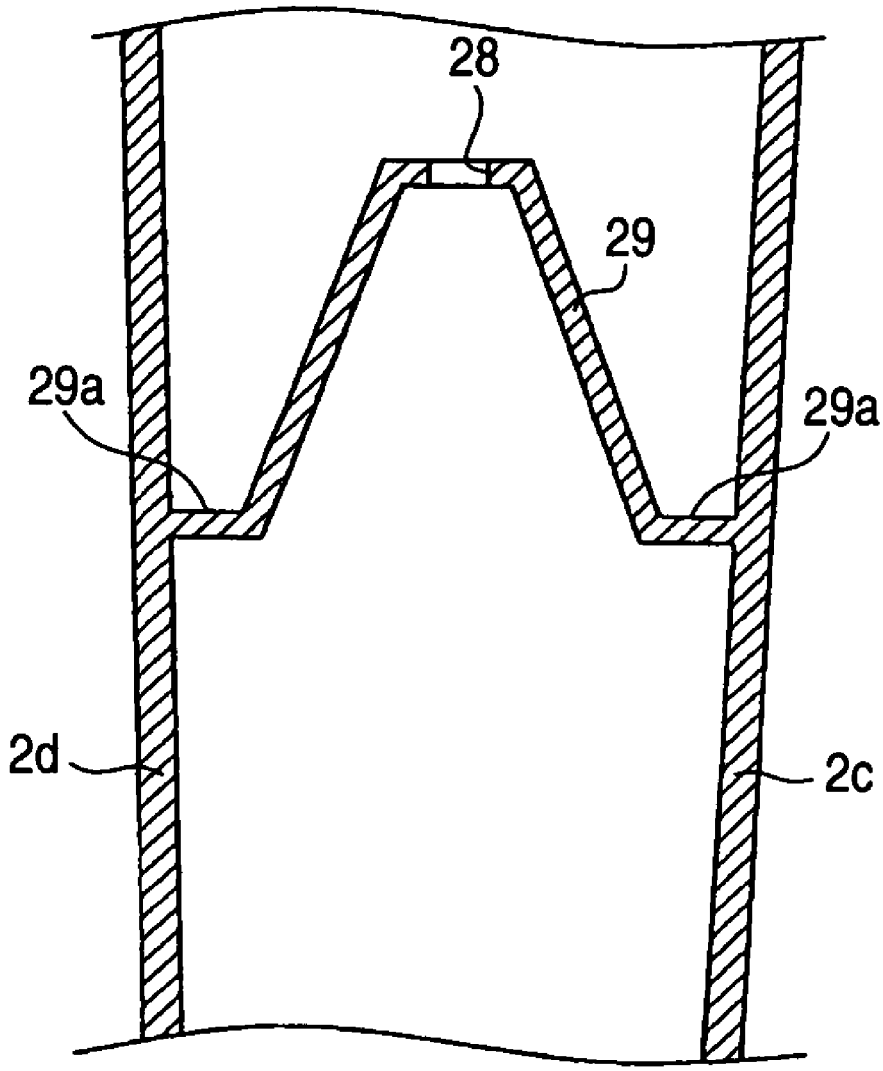
FIG. 4 is a sectional view taken along line IV—IV in FIG. 2.
Figure 5:
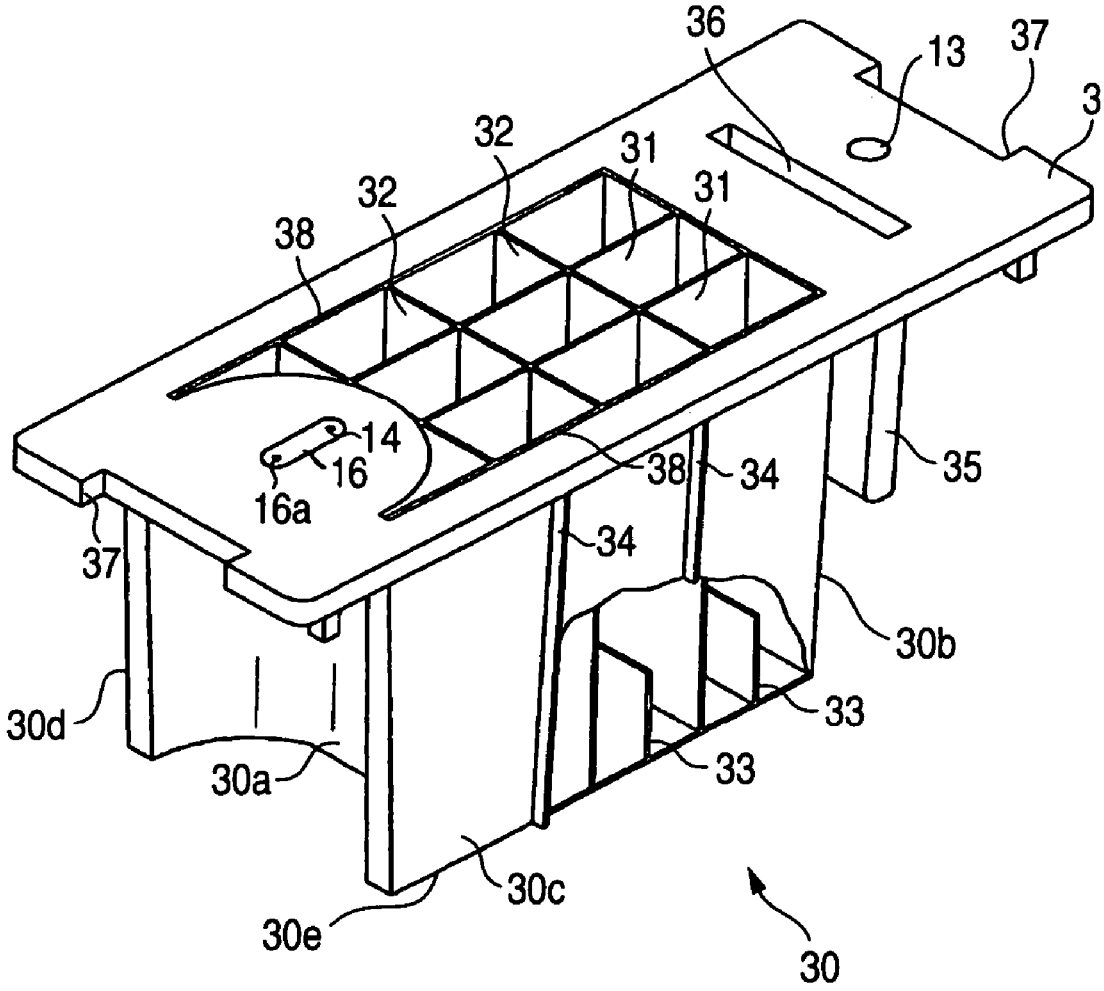
FIG. 5 is a perspective view of a spacer member welded with the upper cover member.

Next, the internal configuration of the ink cartridge 1 will be described with reference to FIGS. 2, 3A–3C, 4 and 5. FIG. 2 is an exploded sectional view of the ink cartridge 1. FIG. 3A is a plan view of the upper cover member 3 observed from the arrow IIIA direction in FIG. 2. FIG. 3B is a plan view of the casing 2 observed from the arrow IIIB direction in FIG. 2. FIG. 3C is a plan view of the lower cover member 4 observed from the arrow IIIC direction in FIG. 2. FIG. 4 is a sectional view of an atmospheric air communication path 10, taken along line IV—IV in FIG. 2. FIG. 5 is a perspective view of a spacer member 30 welded on the upper cover member 3.

The inside of the casing 2 is divided by partition walls 5 and 6 extending substantially in parallel to the first side walls 2*a* and 2*b*, a bottom partition wall 7 connected to the lower ends of the two partition walls 5 and 6 and extending substantially in parallel to the lower cover member 4, and partition walls 7*a*, 7*b* and 7*c* extending substantially vertically from the bottom partition wall 7 toward the lower cover member 4 (see FIG. 3B about the partition wall 7*c*). Incidentally, the partition walls 5 and 6, the bottom partition wall 7 and the partition walls 7*a* and 7*b* extend in a direction bridging the second side walls 2*c* and 2*d*, while the partition wall 7*c* extends in a direction bridging the partition walls 7*a* and 7*b*. The upper ends of the partition walls 5 and 6 are fixedly attached to the lower surface of the upper cover member 3 by heat welding, while the lower ends of the partition walls 7*a*, 7*b* and 7*c* are fixedly attached to the upper surface of the lower cover member 4 by heat welding.

Thus, a first chamber 9 is formed in a portion surrounded by the upper cover member 3, the partition walls 5 and 6, the bottom partition wall 7 and the second side walls 2*c* and 2*d*. A porous material 8 made from polyurethane foam and absorbing ink is received in the first chamber 9. In addition, the atmospheric air communication path 10 is formed in a portion surrounded by the upper and lower cover members 3 and 4, the first side wall 2*a*, the partition wall 5 and the second side walls 2*c* and 2*d*. The atmospheric air communication path 10 is formed substantially into an L-shape out of a vertical portion 10*a* extending along the first side wall 2*a* and a horizontal portion 10*b* located under the first chamber 9. In addition, a second chamber 11 is formed in a portion surrounded by the upper and lower cover members 3 and 4, the first side wall 2*b*, the partition wall 6 and the second side walls 2*c* and 2*d*. The second chamber 11 is also formed substantially into an L-shape out of a vertical portion 11*a* extending along the first sidewall 2*b* and a horizontal portion 11*b* located under the first chamber 9 in the same manner as the atmospheric air communication path 10. Further, a space 20 (see FIG. 3B) is formed in a portion surrounded by the bottom partition wall 7, the partition walls 7*a*, 7*b* and 7*c* and the lower cover member 4.

The first chamber 9 and the second chamber 11 are chambers for receiving ink. The first chamber 9 is formed to be much larger than the second chamber 11, and the first chamber 9 is formed as a main ink chamber. The second chamber 11 serves as a passageway at the time of charging ink as will be described later, and serves as a relay chamber at the time of supplying ink from the first chamber 9 to the recording head 72.

An ink charge port 13 is provided in the upper cover member 3 correspondingly to the upper end open face of the second chamber 11, while a communication hole 15 for connecting the first chamber 9 with the horizontal portion 11*b* of the second chamber 11 is formed in the bottom partition wall 7. Thus, ink to be charged is charged from the ink charge port 13 to the first chamber 9 through the second chamber 11 and the communication hole 15, and absorbed into the porous material 8 in the first chamber 9. In addition, an ink supply port 17 for supplying the ink in the second chamber 11 to the recording head 72 is provided in the lower cover member 4. The ink absorbed in the porous material 8 flows out from the first chamber 9 to the ink supply port 17 through the communication hole 15 and the horizontal portion 11*b* of the second chamber 11, and then ejected from the ink supply port 17.

The atmospheric air communication path 10 is a passageway for supplying the atmospheric air to the first chamber 9 when the ink in the first chamber 9 is consumed. In the atmospheric air communication path 10, the vertical portion 10*a* communicates with the horizontal portion 10*b* through a communication hole 19 (see FIG. 3B) provided in the partition wall 7*b*. Incidentally, the atmospheric air communication path 10 and the second chamber 11 are isolated from each other by the partition wall 7*a* so that the atmospheric air communication path 10 and the second chamber 11 are formed independently of each other.

A first through hole 14 communicating with a location of the first chamber 9 where the porous material 8 is disposed, and a second through hole 16*a* corresponding to the upper end open face of the atmospheric air communication path 10 are provided in the upper cover member 3. Further, a passageway 16 for connecting the first through hole 14 with the second through hole 16*a* is formed like a recess in the upper surface of the upper cover member 3. On the other hand, an atmospheric air communication hole 18 for supplying the atmospheric air to the atmospheric air communication path 10 is formed in the lower cover member 4. Thus, the outside air supplied from the atmospheric air communication hole 18 is supplied to the location of the first chamber 9 where the porous material 8 is disposed, through the atmospheric air communication path 10, the second through hole 16*a*, the passageway 16 and the first through hole 14.

In addition, a partition wall 29 for partitioning the vertical portion 10*a* of the atmospheric air communication path 10 into an upper part and a lower part is formed halfway in the vertical portion 10*a* of the atmospheric air communication path 10 as shown in FIG. 4. The partition wall 29 extends with a difference in elevation in the up/down direction of the atmospheric air communication path 10. A through hole 28 is formed in a high portion of the partition wall 29, and a recess portion serving as an ink reservoir 29*a* is formed in a lower site than the upper end face of the through hole 28. Further, in addition to the ink reservoir 29*a*, a circumferential wall of the atmospheric air communication hole 18 formed in the lower cover member 4 is provided to project upward like a cylindrical shape so as to form an ink reservoir around the atmospheric air communication hole 18.

Due to these ink reservoirs, even when the ink cartridge 1 tilts so that ink leaks from the first chamber 9 to the atmospheric air communication path 10 through the first through hole 14 and the second through hole 16*a*, the ink is reserved in the ink reservoir 29*a*. Even when the ink cartridge 1 tilts so that the ink in the ink reservoir 29*a* further leaks downward through the through hole 28, the ink is reserved in the lower ink reservoir. Accordingly, it is possible to prevent ink from leaking from the atmospheric air communication hole 18 to the outside even when the ink cartridge 1 tilts. Incidentally, the partition wall 29 can be molded at a parting portion of upper and lower split molds when the casing 2 is molded out of resin. Thus, special processing is not required.

The ink charge port 13, the first through hole 14 and the second through hole 16*a* provided in the upper cover member 3 are closed by first sealing materials 21 and 22 pasted to the outer surface of the upper cover member 3 by heat welding or the like after ink is charged. Incidentally, the sealing material 22 covers the upper surface of the passageway 16 while securing the passageway 16. On the other hand, the ink supply port 17 and the atmospheric air communication hole 18 provided in the lower cover member are closed by a second sealing material 23 pasted releasably by heat welding or the like.

The space 20 is a space for forming a decompressed space inside the casing 2. The space 20 is formed as an independent space having no communication with the first chamber 9, the atmospheric air communication path 10 and the second chamber 11. Two openings 24 and 24 (see FIG. 3C) are formed in the lower cover member 4 covering the space 20. The space 20 communicates with the outside of the casing through the openings 24 and 24. When the ink cartridge 1 is placed in a packing bag 64 and the packing bag 64 is decompressed as will be described later, the air in the space 20 is sucked through the openings 24 and 24 so that the space 20 is decompressed. Incidentally, the openings 24 and 24 provided in the lower cover member 4 are not covered with the sealing material 23, but allow the space 20 to communicate with the outside.

In addition to the space 20, another decompressed space is formed inside the casing 2, while a spacer member 30 is formed integrally with the upper cover member 3 so as to project into the first chamber 9 and occupy a predetermined space of the first chamber 9. The spacer member 30 occupies a predetermined space between the porous material 8 and the upper cover member 3 in the first chamber 9.

As shown in FIG. 5, the spacer member 30 has outer circumferential walls 30*a*, 30*b*, 30*c* and 30*d* and a bottom wall 30*e*. The outer circumferential walls 30*a* to 30*d* extend almost along the inner surfaces of the second side walls 2*c* and 2*d* and the partition walls 5 and 6 forming the first chamber 9 in sectional view substantially perpendicular to the projecting direction of the spacer member 30. The bottom wall 30*e* covers the porous material 8 side end portion of the spacer member 30 surrounded by the outer circumferential walls 30*a* to 30*d*. Thus, the spacer member 30 is formed into a hollow box-like shape open in its top. A first opening portion 38 is formed in the upper cover member 3 so as to have substantially the same shape as the open face of the spacer member 30. The upper ends of the outer circumferential walls 30*a* to 30*d* are connected integrally with the circumferential edge of the first opening portion 38. When the spacer member 30 is inserted into the first chamber 9 and the upper cover member 3 is fixedly attached to the casing 2, the bottom wall 30*e* abuts against the porous material 8 so as to compress the porous material 8 slightly.

A predetermined space between the porous material 8 and the upper cover member 3 in the first chamber 9 is occupied by the spacer member 30. Thus, as will be described later, when the ink capacity is large, the ink capacity of the casing 2 can be reduced without changing the shape of the casing 2. In this embodiment, the spacer member 30 has a volume extending from the upper end of the first chamber 9 to the substantially central portion thereof.

Further, when the ink cartridge 1 is placed inside the packing bag 64 and the packing bag 64 is decompressed, the air existing in the space surrounded by the spacer member 30 is sucked through the first opening portion 38 of the upper cover portion 3 (the open face of the spacer member 30) so that the space is decompressed. The decompressed condition in the packing bag 64 is kept for a long time, with the result that the deaerated condition of ink is also kept.

In addition, rib-like protrusion portions 34 abutting against the inner surfaces of the pair of second side walls 2*c* and 2*d* opposed to the outer circumferential walls 30*c* and 30*d* are formed on the outer surfaces of the outer circumferential walls 30*c* and 30*d* respectively. The protrusion portions 34 are formed all over the up/down-direction lengths of the outer circumferential walls 30*c* and 30*d*, so as to fill the gaps between the outer circumferential walls 30*c* and 30*d* and the second side walls 2*c* and 2*d* respectively.

First support walls 31 extending in the opposition direction of the pair of outer circumferential walls 30*a* and 30*b* of the spacer member 30 opposed to each other are connected to the inner surfaces of the outer circumferential walls 30*a* and 30*b* respectively. Second support walls 32 extending in the opposition direction of the pair of the second side walls 2*c* and 2*d* opposed to the pair of outer circumferential walls 30*c* and 30*d* opposed to each other are connected to the inner surfaces of the outer circumferential walls 30*c* and 30*d* respectively. That is, the space inside the spacer member 30 is divided and formed into a grid by the first and second support walls 31 and 32. Even when the space surround by the spacer member 30 is decompressed, the first and second support walls 31 and 32 can prevent the second side walls 2*c* and 2*d* from being crushed inward.

In addition to the second support walls 32, third support walls 33 extending in the same direction as the second support walls 32 but being shorter in height than the second support walls 32 are connected to the lower inner surfaces of the outer circumferential walls 30*c* and 30*d*, that is, closely to the center of the first chamber 9, respectively. In this embodiment, since the third support walls 33 together with the second support walls 32 are connected to the inner surfaces of the outer circumferential walls 30*c* and 30*d*, the second side walls 2*c* and 2*d* can be more surely prevented from being crushed by the aforementioned decompression.

The outer surface of the outer circumferential wall 30*a* is formed into a concave groove extending all over its up/down direction length so as to secure a passageway 39 for making communication between the first through hole 14 provided in the upper cover member 3 and the first chamber 9 where the porous material 8 is placed. The passageway 39 is formed to be surrounded by the first chamber 9 side surface of the partition wall 5 and the outer surface of the outer circumferential wall 30*a*. Thus, a passageway is secured between the first chamber 9 where the porous material 8 is placed and the first through hole 14. In addition, since the passageway 39 is formed to be surrounded by the outer circumferential wall 30*a* formed into a concave groove, the predetermined space between the upper cover member 3 and the porous material 8 in the first chamber 9 excluding the passageway can be occupied by the spacer member 30. Thus, the passageway 39 is secured while the ratio of the air layer communicating with the first chamber 9 where the porous material 8 is placed is suppressed so that the degree of deaeration of ink in the first chamber 9 can be prevented from deteriorating. In addition, since the outer circumferential walls 30*c* and 30*d* extend all over the width of the first chamber 9 in spite of the existence of the passageway 39, the second side walls 2*c* and 2*d* can be prevented from being crushed, as described previously.

In addition to the aforementioned constituent parts, members for detecting the existence of ink are disposed inside the casing 2. An inclined portion 60 inclined with respect to the vertical direction connecting the upper cover member 3 and the lower cover member 4 is formed in the upper portion of the first side wall 2*b*. A prism 61 is disposed on the inner surface of the inclined portion 60. The prism 61 is a member serving to detect the existence of ink reserved in the ink cartridge 1. The prism 61 is molded out of a transparent and light-transmissive material. In a position at a predetermined distance from the prism 61, a reflector member 35 formed integrally with the upper cover member 3 is hung substantially vertically above the second chamber 11. The reflector member 35 is a member for changing the optical path of infrared light radiated from a not-shown ink sensor. The reflector member 35 is disposed obliquely with respect to the prism 61, and formed into a bag-like shape having an air layer. The inside of the reflector member 35 communicates with the outside through a second opening portion 36 (see FIG. 3A) which is open in the upper cover member 3.

When the second chamber 11 has sufficient ink, infrared light radiated from the not-shown ink sensor is transmitted through the prism 61 and the ink in the second chamber 11 and reaches the reflector member 35 because the refractive index of the prism 61 is very close to the refractive index of the ink. The infrared light reaching the reflector member 35 is reflected on the interface between the inner surface of the reflector member 35 and the air inside the reflector member 35 because there is a difference in refractive index between the reflector member 35 and the air. Here, the prism 61 is disposed obliquely with respect to the reflector member 35. Thus, the light quantity of the infrared light returning to the ink sensor is smaller than the light quantity of the infrared light radiated by the ink sensor.

On the other hand, when the second chamber 11 does not have ink, infrared light radiated from the ink sensor is reflected on the interface between the inner surface of the prism 61 and the air because there is a difference in refractive index between the prism 61 and the air. Most of the infrared light returns to the ink sensor. Thus, the light quantity of the reflected light is larger than that in the aforementioned case. In such a manner, the light quantity of reflected light changes in accordance with the existence of ink. Thus, the existence of ink reserved in the second chamber 11 can be detected by detecting such a difference in light quantity.

Although a pair of ribs 62 and 62 opposed to each other at a predetermined distance from each other are not the internal constituent parts of the casing 2, the pair of ribs 62 and 62 are provided to project on the upper portion of the first side wall 2*a*, while a second fitting recess portion 55 is provided to sink in the lower cover member 4. The ribs 62 and 62 and the second fitting recess portion 55 serve to position the ink cartridge 1 when the ink cartridge 1 is attached to the head unit 70, and to prevent the ink cartridge 1 from slipping laterally on the head unit 70.

In addition, engagement grooves 37 and 37 are formed in the opposite end portions of the upper cover member 3. The grooves 37 and 37 are grooves for fitting to engagement claws 54 formed in the opposite end portions of the aforementioned fixing plate 50. When the engagement claws 54 are fitted into the grooves 37 while the fixing plate 50 is mounted on the upper surface of the upper cover member 3, top end portions of the engagement claws 54 catch up the upper cover member 3 so as to fix the fixing plate 50 onto the upper cover member 3.

Even when the fixing plate 50 is fixed onto the upper cover member 3 so as to cover the first opening portion 38 of the upper cover member 3 in such a manner, the first opening portion 38 (the open face of the spacer member 30) open in the substantially central portion of the upper cover member 3 is not perfectly closed by the fixing plate 50. The space formed by the spacer member 30 still remains communicating with the outside through the first opening portion 38 (the open face of the spacer member 30).

Next, a method for manufacturing the ink cartridge 1 will be described. First, the casing 2 is molded out of resin. After that, the porous material 8 is inserted into the first chamber 9 from the upper open face of the casing 2. The upper open face of the casing 2 is closed by the upper cover member 3. The upper cover member 3 is heat-welded with the upper ends of the first and second side walls 2*a* to 2*d* of the casing 2 and the upper ends of the partition walls 5 and 6. In this event, a predetermined space between the upper cover member 3 and the porous material 8 is occupied by the spacer member 30 so that the porous material 8 is elastically pressed by the spacer member 30.

On the other hand, the lower open face of the casing 2 is closed by the lower cover member 4. The lower cover member 4 is heat-welded with the lower ends of the first and second side walls 2*a* to 2*d* of the casing 2 and the lower ends of the partition walls 7*a*, 7*b* and 7*c*. In such a manner, the upper and lower faces of the casing 2 are formed to be substantially open, and the cover members 3 and 4 are heat-welded with the casing 2 from above and from below. Thus, a variety of chambers as described above can be formed. Incidentally, before the work of charging ink, the sealing material 23 is releasably pasted to cover the ink supply port 17 and the atmospheric air communication hole 18 provided in the lower cover member 14.

Next, the work of charging ink into the ink cartridge 1 will be described. The work of charging ink is performed as follows. That is, a not-shown ink charger is brought into tight contact with the ink charge port 13 in the state where the ink supply port 17 and the atmospheric air communication hole 18 of the lower cover member 4 are sealed. Then, a not-shown decompressor is brought into tight contact with the first through hole 14 so as to suck the air in the first chamber 9 through the first through hole 14, while ink is supplied from the ink charge port 13. Thus, the ink is absorbed into the porous material 8 in the first chamber 9 through the second chamber 11 and the communication hole 15.

Incidentally, deaerated ink in which bubbles or the air dissolved in the ink has been eliminated to the utmost is used as the ink to be charged in this process. This is to prevent the bubbles or the air from invading the recording head 72 to thereby prevent a failure in ink ejection from being caused. When the ink has been charged, the sealing materials 21 and 22 are pasted onto the ink charge port 13, the first through hole 14 and the second through hole. Then, the fixing plate 50 is fixed to the upper surface of the upper cover member 3.

Figure 6:
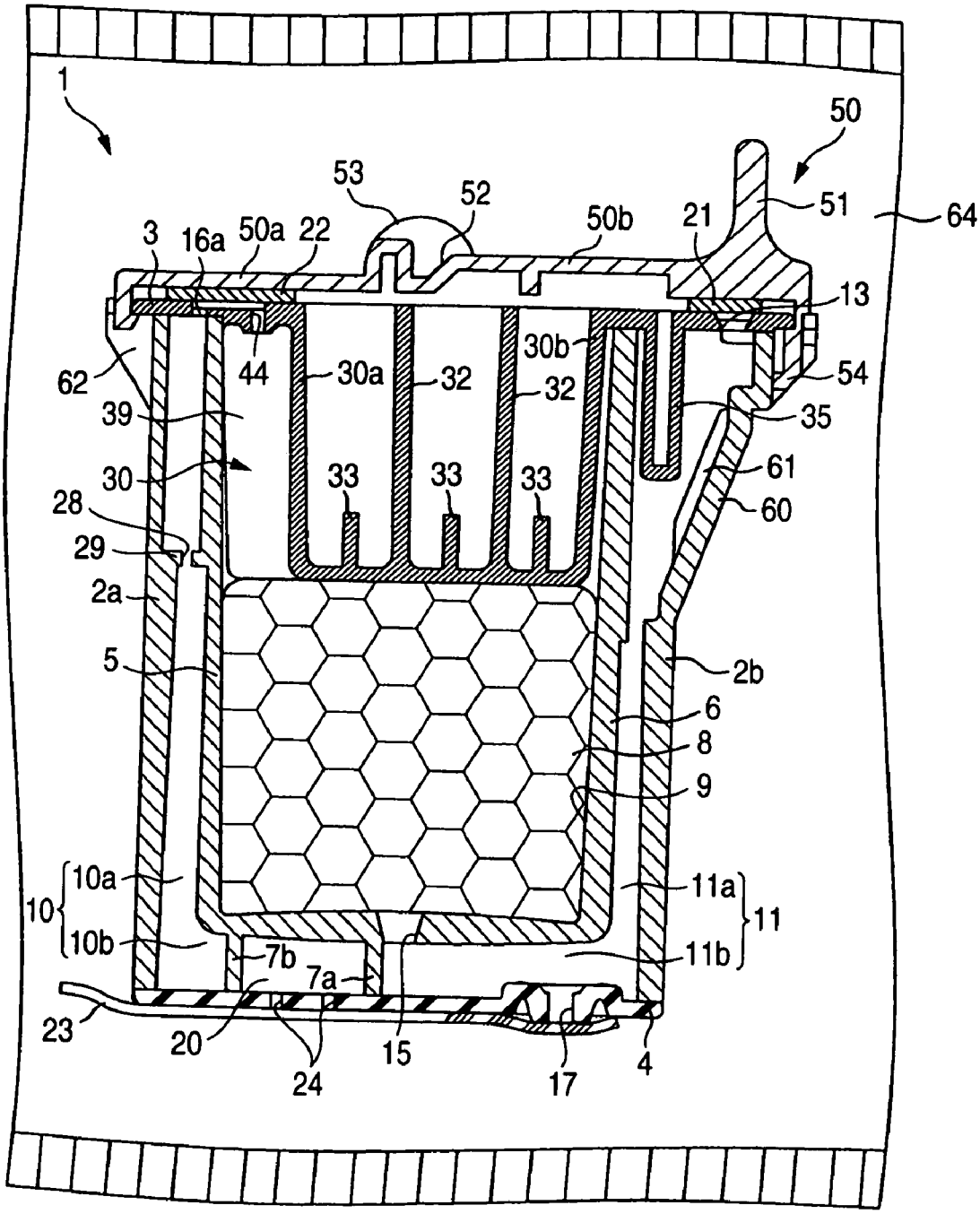
FIG. 6 is a sectional view showing a state where the ink cartridge has been received inside a packing bag.

Next, with reference to FIG. 6, description will be made on the condition of the ink cartridge 1 filled with the ink at the time of shipment. Incidentally, the section of the ink cartridge 1 shown in FIG. 6 corresponds to the section taken along line VI—VI in FIGS. 3B and 3C. The ink cartridge 1 filled with the ink is received and sealed in the packing bag 64 in the decompressed condition at the time of shipment. The packing bag 64 has a cylindrical member, in which the ink cartridge 1 is received. The inside of the cylindrical member is sucked by negative pressure, and the opposite open ends of the cylindrical member are welded. The packing bag 64 is formed out of air-impermeable resin or metal foil, or a laminated material of those.

When the packing bag 64 receiving the ink cartridge 1 is decompressed, the air existing in the space formed by the spacer member 30 is sucked through the first opening portion 38 of the upper cover member 3 (the open face of the spacer member 30) and the gap between the fixing plate 50 and the upper cover member 3. Thus, the space formed by the spacer member 30 is decompressed to the same pressure as that in the packing bag 64. When the air existing in the ink cartridge 1 is discharged in such a manner, the air can be prevented from being dissolved in the ink so that the degree of deaeration of the ink can be prevented from being degraded.

The air existing in the space 20 formed to be surrounded by the bottom partition wall 7, the partition walls 7*a*, 7*b* and 7*c* and the lower cover member 4 is also sucked through the openings 24 and 24 of the lower cover member 4. Thus, the space 20 is also decompressed to the same pressure as that in the packing bag 64. When such decompressed spaces are disposed as many as possible, the degree of deaeration of the ink received in the ink cartridge 1 can be further prevented from deteriorating.

Figure 7:
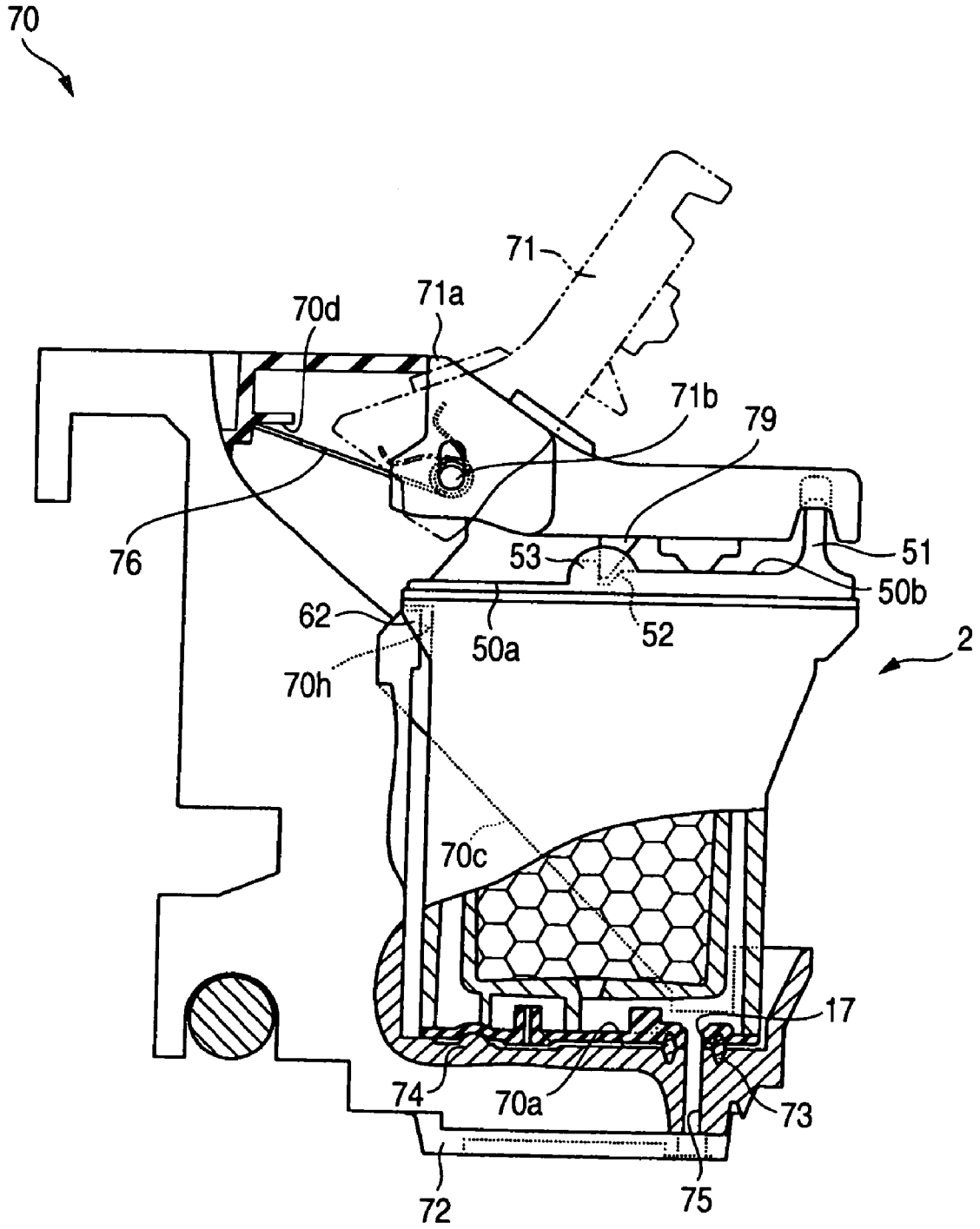
FIG. 7 is a side view showing a state where the ink cartridge has been attached to a head unit.

Next, with reference to FIG. 7, description will be made on the case where the ink cartridge 1 is attached to the head unit 70 of the inkjet recording apparatus. The ink cartridge 1 is attached to the head unit 70 in the state where the sealing material 23 closing the ink supply port 17 and the atmospheric air communication hole 18 has been released by an operator.

The head unit 70 is a member for supplying ink to the recording head 72 from the ink cartridge 1 removably attached to the head unit 70. The head unit 70 is chiefly provided with a mounting portion 70*a* and fixing arms 71. The mounting portion 70*a* is a portion where ink cartridges 1 should be mounted. The mounting portion 70*a* is formed into a substantially flat surface. The mounting portion 70*a* is partitioned into four spaces by three partition plates 70*c*. Four ink cartridges 1 can be mounted in the spaces respectively. Ink supply passageways 75 communicating with the recording head 72 are formed in the mounting portion 70*a* so as to penetrate the mounting portion 70*a*. The ink supply passageways 75 are connected to the ink supply ports 17 of the ink cartridges 1 while being sealed with O-rings 73, respectively.

The fixing arms 71 are members for pressing and fixing the ink cartridges 1 so as to bring the ink cartridges 1 into communication with the ink supply passageways 75 respectively. One end side of each fixing arm 71 is supported so that the fixing arm 71 can move vertically and swing desirably around a swinging shaft 71*b*. In the state where a rising portion 71*a* in the rear end upper portion of the fixing arm 71 is brought into contact with the head unit 70, the fixing arm 71 is prevented from swinging around the shaft 71*b*. The aforementioned first fitting protrusion portion 79 is fitted into the fitting recess portion 52 of the ink cartridge 1 so as to downward press the cartridge as a whole. When the rising portion 71*a* is pressed downward to be released from contact with the head unit, the fixing arm 71 swings upward around the shaft 71*b* by the action of a spring 76 as shown by the chain double-dashed line in FIG. 7. Thus, the ink cartridge 1 can be removed.

In addition, a plurality of protrusions for positioning each ink cartridge 1 or preventing it from slipping laterally are provided in the head unit 70. Specifically, a second fitting protrusion portion 74 for fitting into the second fitting recess portion 55 provided in the lower cover member 4 is provided on the mounting portion 70*a*, while a third fitting protrusion portion 70*h* for fitting between the pair of ribs 62 and 62 provided to project on the second side wall 2*a* of the casing 2 is provided in the surface of the head unit 70 opposed to the second side wall 2*a* of the casing 2.

Thus, when each ink cartridge 1 is attached to the head unit 70, negative pressure acts on the ink to be supplied from the second chamber 11 to the recording head 72 due to the absorptive power of the porous material 8 in the first chamber 9, that is, the capillary action thereof during the recording operation. The actuator of the recording head 72 performs an ink ejection operation to suck the ink from the ink cartridge 1. When the ink in the second chamber 11 flows out from the ink supply port 17, ink is supplied into the second chamber 11 from the porous material 8 in the first chamber 9. With the consumption of the ink in the first chamber 9, the atmospheric air is introduced into the first chamber 9 from the atmospheric air communication hole 18 via the atmospheric air communication path 10.

Since the upper end of the second chamber 11 is sealed with the sealing material 21, the atmospheric pressure does not act on the second chamber 11 in the state where ink has been fully charged into the second chamber 11. The ink in the second chamber 11 will be used after the ink in the first chamber 9 has been nearly used up. That is, when the ink in the first chamber 9 is used up, the air invades the second chamber 11 from the first chamber 9. Thus, an air gap appears from the upper portion of the vertical portion 11*a* of the second chamber 11 so that the ink level comes down. When the ink in the second chamber 11 is detected, it can be detected that the remaining amount has been small.

Figure 8:
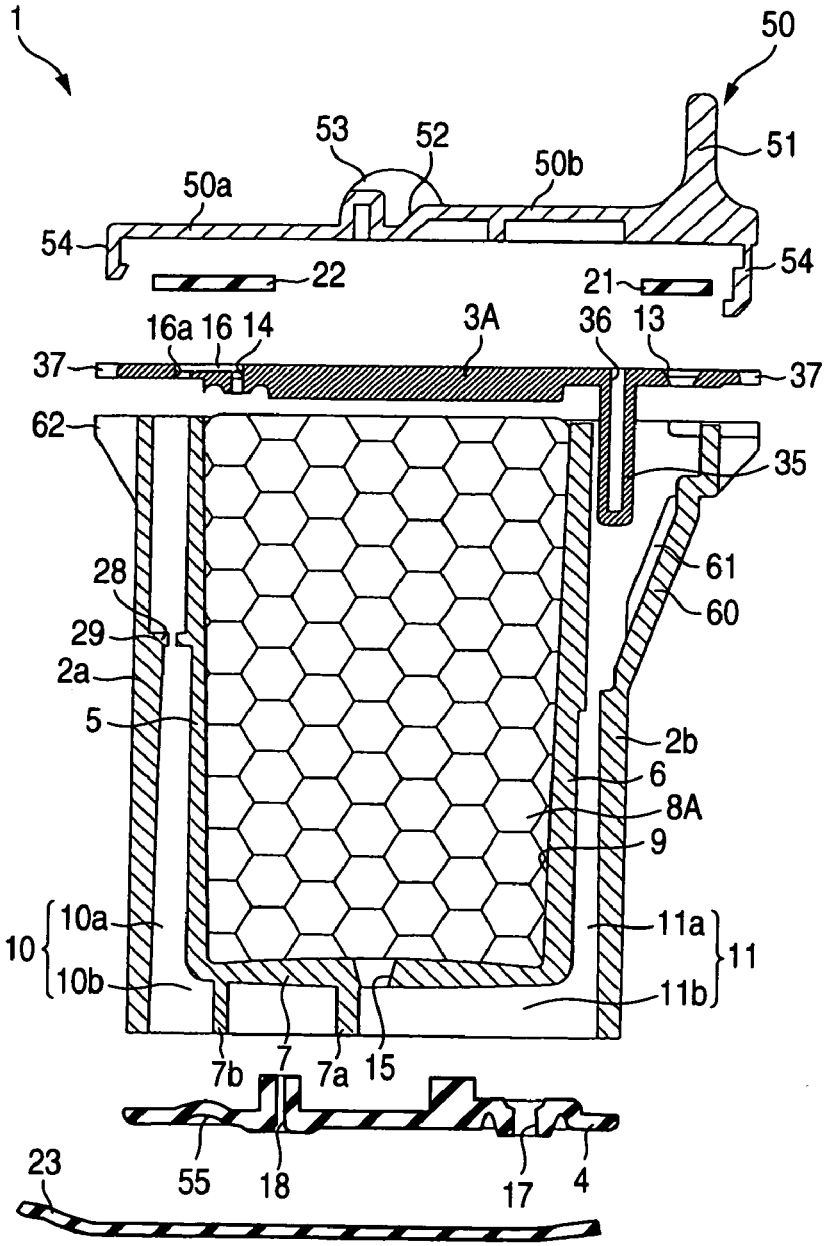
FIG. 8 is a view corresponding to FIG. 2, showing another example of use of the ink cartridge.

FIG. 8 shows an example of use in which the upper cover member 3 of the ink cartridge 1 is replaced by another upper cover member 3A so that a large amount of ink is received in the first chamber 9. In this example, the upper cover member 3A has no part corresponding to the aforementioned spacer member 30. Thus, a porous material 8A is received in the first chamber 9 so as to occupy almost all the first chamber 9, and an amount of ink corresponding thereto is absorbed and retained in the porous material 8A. All the parts other than the upper cover member 3A are the same as those in the aforementioned ink cartridge 1. (Parts the same as those in the aforementioned description are denoted by the same reference numerals correspondingly, and description thereof will be omitted.) In addition, a head unit, a fixing arm, an ink sensor, etc. on the inkjet recording apparatus side which are the same as those in the aforementioned embodiment are used here. In either ink cartridge in the embodiment or in FIG. 8, the ink in the first chamber 9 is consumed before the ink in the second chamber 11 is consumed likewise. Accordingly, the remaining amount of ink can be detected by the ink in the second chamber in the same manner.

Accordingly, if the upper cover member and the porous material are exchanged in one and the same inkjet recording apparatus, the ink cartridge in FIG. 8 receiving a large amount of ink can be provided to a user frequently using the ink-jet recording apparatus while the ink cartridge in the aforementioned embodiment can be provided to a user less frequently using the inkjet recording apparatus.

According to this embodiment, rib-like protrusion portions 34 are formed in outer surfaces of two sides 30*c* and 30*d* of the outer circumferential wall so as to abut against inner surfaces of the pair of side walls 2*c* and 2*d* respectively.

Also, a passageway 39 in the form of concave groove through which the storage space allowing the porous material 8 to be located therein is connected to the outside is formed in an outer surface of a side 30*a* of the outer circumferential wall other than the two sides 30*c* and 30*d*.

Further, the casing 2 has a second open face opposite to the open face; a second cover portion 4 is provided to cover the second open face; a space 20 isolated from the storage space by a partition wall 7*a*, 7*b* and 7*c* is defined on an inner side of the second cover member on the side of the casing; and the space 20 is made open to the outside through an opening portion 24 formed to penetrate the second cover member 4.

In addition, a fixing plate 50 having a fixing member formed for fixing the casing 2 to inkjet recording apparatus is provided in an opposite surface of the first cover member 3 to the storage space, and the fixing plate 50 covers the opening portion of the first cover member 3 while securing communication of the opening portion to the outside.

Furthermore, the ink cartridge 1 further includes an ink chamber 11 lying adjacent to the storage space via a second partition wall 7, wherein the ink chamber 11 communicates with the storage space through a communication hole 15 formed in the second partition wall 7, and includes a supply port 17 for supplying ink to a print head; and the spacer member 30 is provided for the storage space.

The ink in the storage space is supplied into the ink chamber 11 adjacent to the storage space, through the communication hole 15 formed in the second partition wall 7. The ink supplied to the ink chamber 11 flows out from the supply port 17. The spacer member 30 is provided in the storage space though the storage space and the ink chamber 11 can receive ink.

The spacer member 30 has an outer circumferential wall 30*a*, 30*b*, 30*c* and 30*d* extending substantially along the inner surface of the storage space in section perpendicular to the projecting direction of the spacer member 30, and a bottom wall 30*e* covering the porous-material-side end portion of the spacer member 30 surrounded by the outer circumferential wall. The space surrounded by the outer circumferential wall and the bottom wall 30*e* is made open to the outside through the opening portion formed to penetrate the first cover member. Accordingly, when the ink cartridge 1 is placed in the packing member 64 in a decompressed condition, the air existing in the space is sucked so that the space is decompressed. Thus, the air existing in the space is prevented from being dissolved in the ink stored in the storage space so that the degree of deaeration of the ink is prevented from being degraded. Further, a support wall 32 extending in the opposition direction of the pair of side walls of the casing opposed to each other with the storage space being put between the pair of side walls is connected to the inner surfaces of two sides of the outer circumferential wall. Accordingly, the support wall 32 prevents the outer circumferential wall of the spacer member from being crushed inward due to the decompression of the space.

The ink cartridge exerts the following effect in addition to the above-described effect. That is, rib-like protrusion portions 34 are formed in outer surfaces of two sides 30*c* and 30*d* of the outer circumferential wall so as to abut against inner surfaces of the pair of side walls 2*c* and 2*d* respectively. Accordingly, the rib-like protrusion portions 34 can support the pair of side walls so as to prevent the side walls from being crushed inward due to the pressing force generated when the ink cartridge is put under the decompressed condition.

It can be also considered that the outer surface of the outer circumferential wall is formed to abut against the inner surfaces of the side walls in order to withstand the pressing force. In such a case, however, it is difficult to insert the spacer member 30 into the casing 2. On the other hand, according to this ink cartridge 1, the rib-like protrusion portions 34 abut against the inner surfaces of the side walls.

Accordingly, in comparison with the aforementioned case, there is an effect that the spacer member 30 can be inserted into the casing 2 easily.

Also, a passageway 39 through which the storage space allowing the porous material to be located therein is connected to the outside is formed in the outer surface of the outer circumferential wall so as to have a concave groove-like shape in which substantially end portions of the outer circumferential wall 30*c* and 30*d* opposed to the side walls are left as they are. Accordingly, communication between the storage space where the porous material is located and the outside can be secured while suppressing the ratio of an air layer occupying the storage space.

Further, a space 20 isolated from the storage space by a partition wall 7*a*, 7*b* and 7*c* is defined on an inner side of the second cover member on the side of the casing. The space 20 is made open to the outside through an opening portion formed to penetrate the second cover member, and the space 20 is decompressed under the decompressed condition. Accordingly, a decompressed space is formed on the opposite side to the decompressed space formed by the spacer member so that the deterioration in degree of deaeration of ink can be further suppressed.

In addition, the ink cartridge 1 can be fixed to inkjet recording apparatus by a fixing member provided in an opposite surface of the first cover member to the storage space. In addition, even when the fixing plate 50 where the fixing member is formed covers the opening portion of the first cover member, the communication of the opening portion of the first cover member to the outside is secured. Accordingly, the communication between the space formed by the spacer member and the outside can be secured through the opening portion of the first cover member.

Furthermore, the spacer member 30 is provided not for the ink chamber 11 having a supply port for supplying ink but for the storage space adjacent to the ink chamber through the second partition wall. Accordingly, good ink supply from the ink chamber to the print head can be kept regardless of the size of the storage space.

Although the invention has been described above based on its embodiment, the invention is not limited thereto. The invention can be improved or modified variously without departing from the gist of the invention.

For example, although the embodiment has shown the case where the spacer member 30 has a size to occupy about half the space of the first chamber 9, the size of the spacer member 30 is not limited thereto, but can be adjusted desirably in accordance with an intended amount of ink to be received. When the size of the spacer member 30 is adjusted, the ink capacity can be adjusted desirably without changing the shape of the casing 2.

What is claimed is:

1. An ink cartridge comprising:

a casing having at least one open face and receiving ink, the casing including a storage space that receives a porous material for absorbing ink and having a pair of sidewalls opposed to each other while putting the storage space therebetween;

a first cover member that closes the open face of the casing while facing to the storage space; and a spacer member projecting from the first cover member into the storage space so as to occupy a predetermined space between the porous material and the first cover member in the storage space, the spacer member having an outer circumferential wall, a bottom wall and a support wall, the outer circumferential wall extending substantially along an inner surface of the storage space in section perpendicular to a projecting direction of the spacer member, the bottom wall covering a porous-material-side end portion of the outer circumferential wall, the support wall extending in a direction crossing the pair of side walls of the casing to be connected to inner surfaces of two sides of the outer circumferential wall opposed to the pair of side walls;

wherein a space surrounded by the outer circumferential wall is made open to the outside through an opening portion formed to penetrate the first cover member.

2. The ink cartridge according to claim 1, wherein protrusion portions in the form of rib are formed in outer surfaces of two sides of the outer circumferential wall so as to abut against inner surfaces of the pair of side walls respectively.

3. The ink cartridge according to claim 1, wherein a passageway in the form of concave groove through which the storage space allowing the porous material to be located therein is connected to the outside is formed in an outer surface of a side of the outer circumferential wall other than the two sides.

4. The ink cartridge according to claim 1, wherein the casing has a second open face opposite to the open face;

a second cover portion is provided to cover the second open face;

a space isolated from the storage space by a partition wall is defined on an inner side of the second cover member on the side of the casing; and the space is made open to the outside through an opening portion formed to penetrate the second cover member.

5. The ink cartridge according to claim 1, wherein a fixing plate having a fixing member formed for fixing the casing to an inkjet recording apparatus is provided in an opposite surface of the first cover member to the storage space, and the fixing plate covers the opening portion of the first cover member while securing communication of the opening portion to the outside.

6. The ink cartridge according to claim 1, further comprising:

an ink chamber lying adjacent to the storage space via a second partition wall;

wherein the ink chamber communicates with the storage space through a communication hole formed in the second partition wall, and includes a supply port for supplying ink to a print head; and the spacer member is provided for the storage space.

7. The ink cartridge according to claim 1, wherein the ink cartridge is placed in a packing member in a decompressed condition and the space surrounded by the outer circumferential wall is decompressed under the decompressed condition.

8. The ink cartridge according to claim 4, wherein the ink cartridge is placed in a packing member in a decompressed condition and the space is decompressed under the decompressed condition.

9. The ink cartridge according to claim 1, wherein the support wall extends in a direction perpendicular to the pair of side walls of the casing.

10. The ink cartridge according to claim 1, wherein the spacer member is integrally formed with the first cover member.

* * * * *